United States Patent [19]

Farrell, Jr.

[11] 4,253,813

[45] Mar. 3, 1981

[54] APPARATUS FOR APPLYING A FLOWABLE COATING MATERIAL TO THE INTERIOR OF A STACK

[76] Inventor: Eugene C. Farrell, Jr., 434 70th Ave., Box 677 E., East Moline, Ill. 61265

[21] Appl. No.: 83,148

[22] Filed: Oct. 9, 1979

[51] Int. Cl.[3] ..... B29C 23/00; B28B 1/30

[52] U.S. Cl. ..... 425/90; 118/408; 118/713; 401/9; 401/188 A; 425/95; 425/96; 425/102; 425/173; 425/375; 425/427; 425/447; 425/460; 425/457

[58] Field of Search ..... 264/267; 425/90, 96, 425/99, 103, 106, 169, 173, 460, 262, 426, 427, 470, 63, 64, 95, 97, 375, 99, 447, 457, 59; 405/133, 150, 249, 233, 240, 287; 118/306, 317, 318, 408, 105, 713; 401/9, 10, 188; 406/162

[56] References Cited

U.S. PATENT DOCUMENTS

| | | | |
|---|---|---|---|
| 1,147,374 | 7/1915 | Coe | 401/9 |
| 2,369,720 | 2/1945 | Crane | 401/9 |
| 2,420,062 | 5/1947 | Ames | 401/9 |
| 2,824,443 | 2/1958 | Ames | 401/9 |
| 2,889,965 | 6/1959 | Ames | 401/9 |
| 2,910,042 | 10/1959 | Gallmeyer | 118/105 |
| 3,058,137 | 10/1962 | Doyle et al. | 118/408 |
| 3,071,107 | 1/1963 | Stanley | 118/306 |
| 3,856,453 | 12/1974 | Wells et al. | 425/447 |
| 3,895,604 | 7/1975 | Ryan | 118/306 |
| 3,989,006 | 11/1976 | Estebanez | 118/306 |
| 4,055,958 | 11/1977 | Hanson | 425/59 |
| 4,205,949 | 6/1980 | Hanson | 425/64 |

FOREIGN PATENT DOCUMENTS

| | | | |
|---|---|---|---|
| 243725 | 6/1926 | United Kingdom | 401/10 |

*Primary Examiner*—W. E. Hoag
*Attorney, Agent, or Firm*—Henderson & Sturm

[57] ABSTRACT

The disclosure is of a method and means for applying a flowable coating material, such as relining, to a tubular stack; e.g. chimney, flue or the like, by means of a distributor moved upwardly into the stack while supplying coating material to an upper surface of the distributor which is configured to cause the material to flow outwardly to the wall to adhere thereto. The apparatus includes selectively added extensions for moving the distributor incrementally through the length of stacks of considerable height, preferably by means of power-operated means; e.g., a fluid-pressure device.

15 Claims, 10 Drawing Figures

FIG. 7
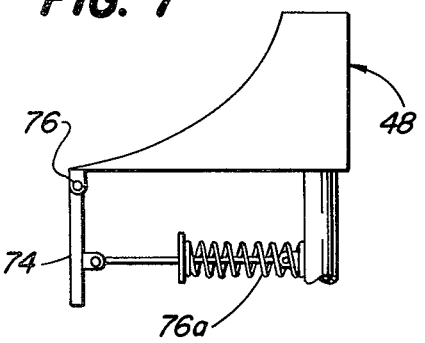
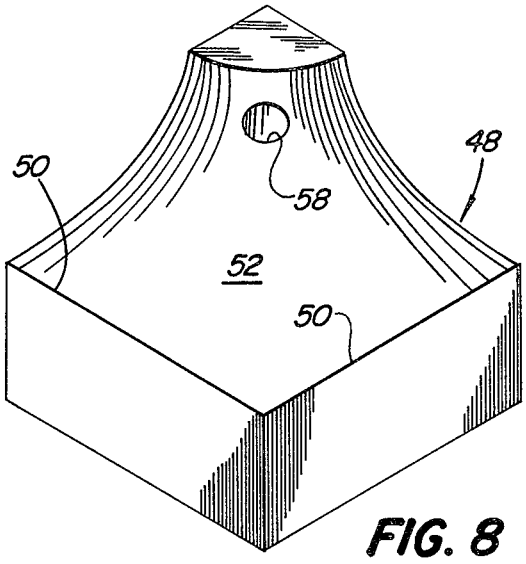
FIG. 8
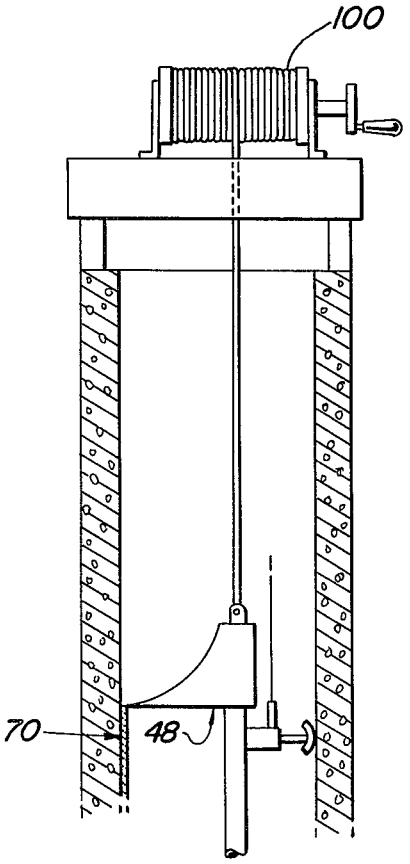
FIG. 9
FIG. 10
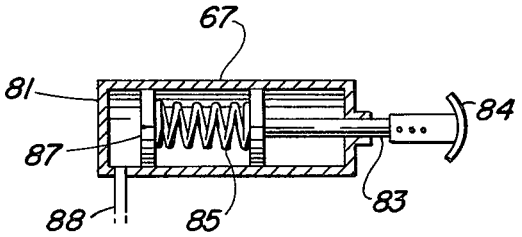

APPARATUS FOR APPLYING A FLOWABLE COATING MATERIAL TO THE INTERIOR OF A STACK

BRIEF SUMMARY OF THE INVENTION

The invention relates to the art of applying interior coating, such as fire mortar and the like, to the walls of a stack, chimney, flue, etc. as distinguished from re-building the stack or re-lining it with pre-built tubular means such as tile, metal and the like.

A basic problem in re-lining or re-coating a stack or chimney arises because of the relative inaccessibility of elevated areas; i.e., those not easily reached through the top or bottom of the stack. Even then, the repair material has heretofore been hand-troweled in place, resulting in unsatisfactory and incomplete repairs.

According to the present invention, these problems have been solved by the use of a system involving a combination distributor and trowel means movable lengthwise of the stack while mortar or "mud" is supplied to the distributor. The distributor is configured to cause the coating material, or mortar, to flow outwardly over the upper surface of the distributor to a marginal edge portion from which depends a trowel element. The distributor is guided up and down the stack and the mortar flows over the distributor edge and adheres to the stack wall being coated, the guide or gage means being set to produce the desired thickness of the coating. As the distributor advances, the trowel smoothes the motar in place. The guide means is constructed to accommodate uneven areas in the stack. A further feature is the use of a mirror and illumination to enable the workman to view the application of the mortar.

It is an object of the invention to provide a means and method for moving the distributor lengthwise of the stack, preferably in several trips or "passes" to insure a thorough job, besides which the system is adapted to stacks of rectangular or circular cross-section. One method of moving the distributor involves working from the bottom of the stack, especially in instances of the taller industrial chimneys. A preferred means is power-operated by, for example, a fluid ram or air jack for elevating successively connected lengths of pipe or tubing through which the mortar is supplied as the distributor advances. The mortar is introduced to the distributor from below and caused to spread or flow over a sloping top surface of the distributor to the wall portion(s) being coated. In the case of shorter stacks, such as home chimneys, the distributor can be operated from above.

DESCRIPTION OF THE DRAWINGS

FIG. 7 is an elevation of a modified form of distributor.

FIG. 8 is a perspective of the distributor of FIG. 2.

FIG. 9 is a sectional view showing application of the system to a method of coating from the top of a chimney.

FIG. 10 is a sectional view of a modified form of gage or guide means.

DETAILED DESCRIPTION

Figure 6:
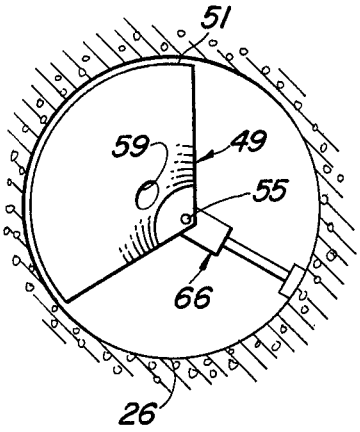
FIG. 6 is a view like FIG. 2 but showing a distributor for use in stacks of circular section.
Figure 2:
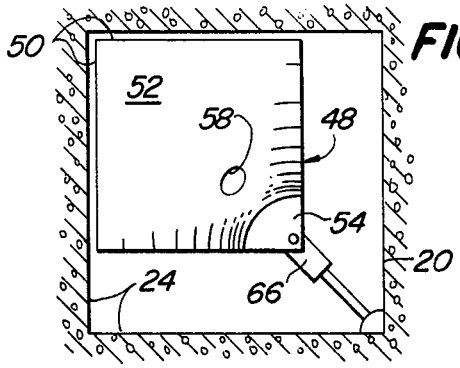
FIG. 2 is a section on the line 2—2 of FIG. 1.
Figure 5:
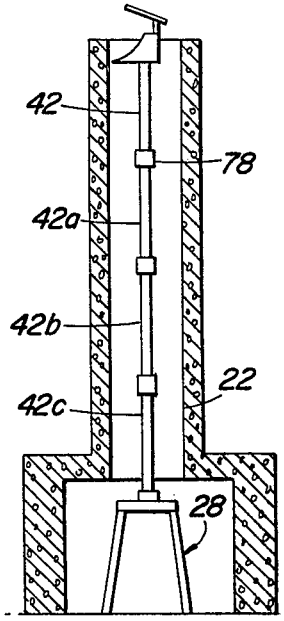
FIG. 5 is a smaller-scale view of the apparatus with additional or extension pipes and showing the distributor advanced to a higher point in the stack.
Figure 1:
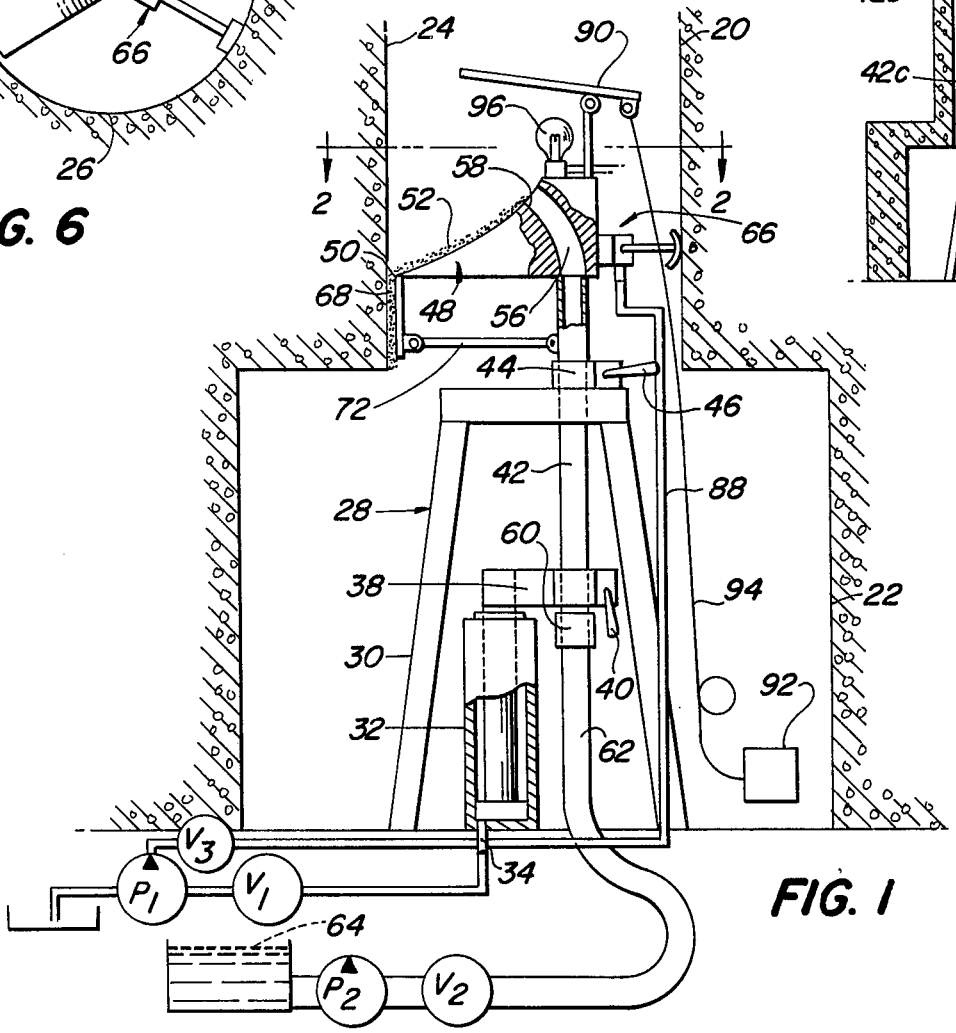
FIG. 1 is a fragmentary sectional view of one form of the invention employing the use of power means operative from the bottom of the stack.

The invention is applicable to elongated, vertical, tubular structures such as chimneys, flues and the like. By way of illustration, a typical chimney is shown in FIGS. 1, 2 and 5 at 20 as having an enlarged bottom portion 22 and rectangularly related interior walls 24. FIG. 6 shows a stack 26 of circular section, to which the invention is equally applicable. Before the stack is re-coated, its interior is sanblasted, for example, to remove all loose particles.

For the purpose of coating the chimney with mortar or "mud" from below, one form of the invention utilizes a base or support unit 28 comprising a tripod 30 and a power-operated means such as an air jack 32. Means for powering the jack is shown schematically here as a source $P_1$ of air under pressure having its output line 34 connected to the jack by control means such as a valve $V_1$. The jack typically includes a piston and piston rod 36 to the upper end of which is attached any suitable clamp means 38, releasable and engageable at 40 to grasp securely the lower end of a tubular member or pipe section 42. The upper part of the tripod is equipped with clamp means 44, which may be similar to that at 38 and which is engageable with and disengageable from the pipe 42, as at 46.

The pipe 42 extends upwardly from the jack clamp and through the tripod clamp into the lower part of the stack and has affixed to its upper end a distributor 48. As best seen in FIG. 2, with respect to a stack of square or rectangular section, the distributor has a pair of horizontally co-planar edge portions 50 related to each other and at a ninety-degree angle. From these, an upper surface 52 of the distributor slopes in curved fashion to a relatively elevated or high portion 54 offset laterally from the edge portions toward the centerline of the stack. The distributor has an interior passage or conduit 56 which opens at its upper end as an outlet 58 to the sloping surface 52 and which, at its lower end, is in communication with the interior of the pipe 42.

The lower end of the pipe 42 is disconnectibly connected by an suitable coupling 60 to a mortar or mud supply line 62 which is in turn connected to a mud supply 64 by means of a pump $P_2$ and valve $V_2$. From the description thus far, it will be seen that the start of the re-mortaring process begins with the positioning of the pipe as shown in FIG. 1, the piston rod clamp being engaged with the pipe and the tripod loose to serve as a guide. The pump $P_2$, now connected to the pie via the mud line 62 and coupling 60, is operated to deliver mud upwardly to the upper surface of the distributor by means of the passage 56 and outlet 58 to flow outwardly and downhill over that surface to two adjoining interior wall portions 24 of the stack.

Figure 4:
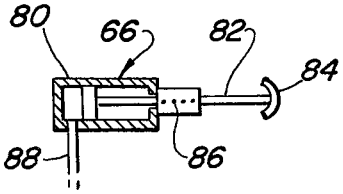
FIG. 4 is a sectional view of one form of gage or guide means for the distributor.

The distributor is gaged relative to the wall portions by gage means 66 (FIG. 4) so as to maintain a selected position to assure descent of the mortar over the edge portions 50 to the respective wall portions of the stack, as seen at 68 in FIG. 1. As the mortar supply is continued, the air jack is operated to elevate the pipe 42 and distributor at a rate commensurate with the desired mortar coating. As the distributor advances upwardly into the stack and the mortar descends below the distributor, the mortar is troweled into place by trowel means 70 (FIGS. 1 and 8) attached to and descending from the distributor edges 50. In this form of the invention, the trowel means is rigid with the distributor and may be braced as shown at 72 (FIG. 1). In a modified form of the distributor (FIG. 7), the trowel means may include depending plates 74 pivoted to the distributor edges, respectively, and backed up by spring-loaded brace means 76*a*.

When the pipe 42 had advanced as far as permitted by the stroke of the air jack, pressure to the jack is discontinued, as is the supply of mortar to the distributor. The tripod clamp is now applied, the piston rad clamp is released and the jack is retracted to its starting position, the coupling 60 being first disconnected. A second pipe 42*a* (FIG. 5) is connected to the bottom of the pipe 42, as by a typical coupling 78 and the mortar supply line is connected to the bottom of the second pipe by the coupling 60. The mortar supply is activated and the jack clamp engaged with the second pipe, following which the jack is powered to elevate the two pipes 42 and 42*a* in unison, it being seen that the second pipe is a depending extension of the first pipe. This enables advance of the distributor another increment or step up the stack and adjacent portions of the stack walls are coated as before. Each time the jack reaches the end of its stroke, the above process is repeated, further pipe sections 42*b*, 42*c* etc. being added, depending upon the height of the stack. Thus, after the starting point of FIG. 1, the distributor is incrementally advanced until the entire length of the concerned stack wall portions are coated. Return of the apparatus to its starting position entails the successive removal of the added pipe sections.

Because the distributor is designed to cover only one corner and the adjoining wall portions of the stack, the distributor, when again reaching its starting position, is rotated about the vertical axis of the stack, say ninety-degrees clockwise as seen in FIG. 2. This places the distributor edges in coating relation to another corner and its adjoining wall portion. In the case of a rectangular stack, four changes of angular position are required. Limiting the coating to less than the entire stack at once insures proper application of coating and adequate troweling by the means 70 (or 74). Also, in a rectangular stack, the gage means will operate against or in the corner diagonally opposite the corner at which the coated wall portions meet.

The distributor (FIG. 48 in FIG. 2 and FIG. 49 in FIG. 6) occupies substantially less than the whole open area of the stack cross-section and is adapted to line only a limited sector or interior peripheral portion of the stack in a single pass so that repeated passes are required to line the entire stack.

In one form of gage means (FIG. 4) an air cylinder 80 has a piston and rod 82 connected to a guide follower or skid 84, preferably by means 86 providing for selective adjustment of the length of the piston rod to more readily accommodate the gage means to stacks of different dimensions. The gage may be remotely controlled by means of an air line 88 connected to the pump $P_1$ by a valve $V_3$.

In another form of gage means 67 (FIG. 10), an air cylinder 81 has its piston rod 83 connected to the skid 84 by adjustment means 86 as before, but in this case a spring 85 is interposed between the piston and a second piston 87 to provide yieldability of the gage, which more readily accommodates imperfections in the stack corners. The gage means 67 is connected to the air line 88 and is remotely controlled as already described in connection with the gage means 66.

When a circular stack is to be re-mortared a distributor 49 (FIG. 6) is used. This has an arcuate edge 51 from which an upper surface 52 slopes as before to an elevated portion 55 having a mortar outlet 59. The use and operation of this form of distributor will be clear from what has gone before.

Figure 3:
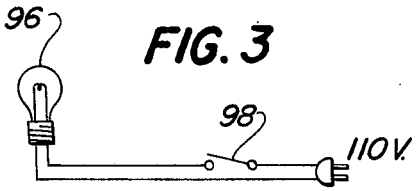
FIG. 3 is a schematic of a lighting circuit for illuminating the distributor.

In order to enable the workman below to observe the mortaring operation, the distributor is equipped with means to provide this information, here in the form of a mirror 90 suitably supported atop the distributor and remotely controlled from below as to positioning, as at 92 via a captive cable means 94 of any suitable type. To further augment the viewing, an electric lamp 96 may be carried by the distributor and connected 110 *v.* as shown in FIG. 3. A remote switch 98 may be included in the wiring circuit.

In the case of house chimneys in which sufficient room may not be available at the bottom of the chimney and where extreme height is not present, the distributor may be operated from above, as by a winch and cable means 100. The distributor may be constructed exactly as those described above, as to gage means, mirror, trowel means, etc. The functioning as to movement up and down the chimney, changes in angular position to accommodate related walls, etc. proceeds as before but the motive force is supplied by the cable and winch means.

The operation of the methods and apparatuses will be clear from the foregoing and need not be repeated. The invention features simplicity, ease of operation and accurate and complete re-mortaring. Other features will readily suggest themselves from the preceding description.

I claim:

1. Apparatus for applying a flowable coating material to a limited sector only of an interior wall of a tubular stack such as a chimney, flue and the like in a single pass, comprising: a distributor disposed at a starting point in the stack, said distributor having an upper surface sloping downwardly and laterally toward only the wall sector to be coated; coating material supply means; means for conducting coating material from said supply means to the upper surface of the distributor for flowing to said wall sector; means for advancing the distributor in the stack while the coating material is supplied to said upper surface for coating the wall sector continuously during advance of the distributor; gage means for causing the distributor to follow the wall sector as it advances; means for discontinuing supply of material to the distributor; and means for causing return of the distributor to its starting point.

2. The apparatus of claim 1, including: trowel means connected to and disposed below the distributor for troweling the coated wall sector as the distributor advances.

3. The apparatus of claim 1, in which: the distributor is adapted to be changed as to its angular position about the vertical axis of the stack so as to direct its upper surface selectively to other interior wall sectors of the stack.

4. The apparatus of claim 1 in which: the means for conducting coating material to the distributor includes a rigid, vertical tubular member attached at its upper end to the distributor and depending therefrom, said upper end including an opening for passage of coating material to said upper surface; support means is disposed below the distributor, including means for selectively holding the tubular member adjacent to its lower end after the member and distributor have advanced upwardly to a predetermined extent; said lower end of the member has a disconnectible coupling to the material supply means for disconnection from said supply means; a second tubular member is selectively connectible between said lower end of the first member and the supply means as a depending extension of said first member; and the aforesaid holding means is releasable to enable the advance of the two interconnected members farther upwardly into the stack.

5. The apparatus of claim 1, in which the gage means is adjustable to vary the lateral relationship of the distributor to the wall sector.

6. The apparatus of claim 5, including: remote control means for controlling the adjustability of the gage means is adpated to be changed as to its angular position about the vertical axis of the stack so as to direct its upper surface selectively to other interior wall sectors of the stack.

7. The apparatus of claim 1, in which: the means for causing advance and retraction of the distribution are combined into a force-exerting device.

8. The apparatus of claim 7, in which said force-exerting device is power operated.

9. The apparatus of claim 1, including: means disposed above and movable with the distributor for informing a viewer of the functioning of the distributor.

10. The apparatus of claim 9, in which: said last-named means is a mirror having its reflective surface aimed toward the distributor and said wall sector.

11. The apparatus of claim 10, in which: said last-named means also includes means for illuminating the mirror.

12. A distributor for applying a coating material to a limited sectorial interior wall portion of a tubular stack such as a chimney, flue and the like comprising a member having a horizontal marginal edge portion adapted to follow the limited wall portion only said member further having a high portion spaced above said plane and laterally from said edge portion, a spreading surface sloping from said high portion to and meeting said edge portion, and means adjacent to said high portion for receiving coating material for flowing across the spreading surface to said edge portion.

13. The distributor of claim 12, in which said edge portion is arcuate to adapt to the coating of structures of circular cross section.

14. The distributor of claim 12, in which said edge portion comprises a pair of horizontally co-planar edge portions normal to each other to adapt the distributor to structures of rectangular cross section.

15. The distributor of claim 12, including means attached to the member in opposed relation to the edge portion for engaging a wall of the structure opposite to that being coated.

* * * * *